US007266179B2

(12) United States Patent
Deuringer et al.

(10) Patent No.: US 7,266,179 B2
(45) Date of Patent: Sep. 4, 2007

(54) X-RAY RADIATOR WITH COLLIMATED FOCAL SPOT POSITION DETECTOR

(75) Inventors: Josef Deuringer, Herzogenaurach (DE); Ronald Dittrich, Forchheim (DE); Jörg Freudenberger, Eckental (DE); Peter Schardt, Höchstadt A.D. Aisch (DE); Jens Uecker, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 9 days.

(21) Appl. No.: 11/134,793

(22) Filed: May 20, 2005

(65) Prior Publication Data

US 2005/0265521 A1 Dec. 1, 2005

(30) Foreign Application Priority Data

May 21, 2004 (DE) ..... 10 2004 025 119

(51) Int. Cl.
*H01J 35/30* (2006.01)
*H01J 35/14* (2006.01)

(52) U.S. Cl. ..... 378/137; 378/138

(58) Field of Classification Search ..... 378/16, 378/19, 98.8, 137, 138, 205, 7, 140, 147, 378/149, 154, 161, 207, 145
See application file for complete search history.

(56) References Cited

U.S. PATENT DOCUMENTS 3,859,534 A * 1/1975 Loughlin ..... 378/203
4,472,827 A * 9/1984 Gabbay et al. ..... 378/140
4,675,892 A 6/1987 Plessis et al. ..... 378/145
5,033,074 A * 7/1991 Cotter et al. ..... 378/147
5,065,420 A * 11/1991 Levene ..... 378/137
5,550,886 A * 8/1996 Dobbs et al. ..... 378/19
5,550,889 A * 8/1996 Gard et al. ..... 378/113
5,657,364 A * 8/1997 Pfoh ..... 378/137
5,684,855 A * 11/1997 Aradate et al. ..... 378/4
5,689,541 A * 11/1997 Schardt ..... 378/140
5,828,727 A * 10/1998 Schild ..... 378/140
5,867,553 A 2/1999 Gordon et al. ..... 378/4
6,056,437 A * 5/2000 Toth ..... 378/205
6,094,469 A * 7/2000 Dobbs et al. ..... 378/19
6,215,844 B1 * 4/2001 Adachi et al. ..... 378/19
6,256,364 B1 * 7/2001 Toth et al. ..... 378/4
6,370,218 B1 * 4/2002 Toth et al. ..... 378/19
6,411,672 B1 * 6/2002 Sasaki et al. ..... 378/19

(Continued)

FOREIGN PATENT DOCUMENTS

DE 36 32 811 A1 4/1987

(Continued)

OTHER PUBLICATIONS

B. D. Cullity and S. R. Stock. Elements of X-Ray Diffraction, Third Edition (New Jersey: Prentice-Hall, 2001), p. 270-272.*

*Primary Examiner*—Allen C. Ho
(74) *Attorney, Agent, or Firm*—Schiff Hardin LLP

(57) ABSTRACT

An x-ray radiator with an anode accommodated in a housing such that it can rotate around an axis has a device for determination of the position of an x-ray-emitting focal spot on the anode. To increase the measurement precision, the device includes a collimator aligned on the focal spot.

17 Claims, 3 Drawing Sheets

U.S. PATENT DOCUMENTS

| | | | | |
|---|---|---|---|---|
| 6,652,143 | B2 * | 11/2003 | Popescu | 378/207 |
| 6,707,876 | B2 * | 3/2004 | Tanigawa | 378/19 |
| 7,001,071 | B2 * | 2/2006 | Deuringer et al. | 378/205 |
| 7,072,439 | B2 * | 7/2006 | Radley et al. | 378/47 |
| 2005/0129175 | A1 * | 6/2005 | Shen et al. | 378/62 |
| 2006/0039527 | A1 * | 2/2006 | Malamud | 378/7 |
| 2006/0093092 | A1 * | 5/2006 | Kuhn | 378/145 |

FOREIGN PATENT DOCUMENTS

| | | | |
|---|---|---|---|
| DE | 196 11 228 | C1 | 10/1997 |
| DE | 198 32 972 | A1 | 1/2000 |
| DE | 40 23 490 | C2 | 7/2001 |

* cited by examiner

X-RAY RADIATOR WITH COLLIMATED FOCAL SPOT POSITION DETECTOR

BACKGROUND OF THE INVENTION

Field of the Invention

The present invention concerns an x-ray radiator of the type having an anode contained in a housing and an arrangement for determining the position of the x-ray-emitting focal spot on the anode.

X-ray radiators of the above general type are known in the art. An x-ray beam strikes, for example, a radially outlying region of a rotating anode plate. To produce precise x-ray images, it is necessary for the focal spot formed by the deceleration of the electrons striking the anode plate to maintain an exact position. As a result of different causes, the position of the focal spot may change. An electron beam directed toward the anode plate can be adjusted by magnetic devices to correct the position of the focal spot. For this purpose, spatially resolved x-ray sensors, with which the intensity of a ray beam emitted by the x-ray radiator can be measured at the edge, are mounted outside of a housing of the x-ray radiator for determination of the position of the focal spot. A conclusion is indirectly made about the position of the focal spot as a result of this measurement, and if necessary the position can be corrected by the magnetic devices.

Rotary piston radiators also are known in the art. An anode that is fashioned rotationally-symmetric is a component of a piston that is mounted such that it can rotate. The rotary piston rotates around its axis in a liquid coolant. An electron beam emanating from the cathode is deflected by magnetic devices such that it strikes a predetermined focal spot on the anode. The rotary piston radiator is surrounded by a housing that is essentially impermeable to x-ray radiation. Only a window is provided for allowing the x-ray radiation to exit. The measurement of the position of the focal spot also ensues indirectly with rotary piston radiators, meaning by means of sensors mounted outside of the housing. The position of the focal spot cannot be particularly precisely determined in this manner, as with x-ray radiators with rotary anodes.

SUMMARY OF THE INVENTION

An object of the present invention is to provide an x-ray radiator that avoids the disadvantages according to the prior art. In particular an x-ray radiator should be specified in which the position of the focal spot can be optimally precisely determined.

The object is achieved according to the invention in an x-ray radiator that has a collimator aligned toward the focal spot that serves to determine the position of the focal spot. Departing from prior art, the determination of the position of the focal spot does not ensue outside of the housing by a measurement of the intensity in the edge region of the ray beam. Instead, the position of the focal spot is determined directly using a collimator directed toward said focal spot. This enables a particularly exact determination of the position of the focal spot. The focal spot can be set to a predetermined desired position with a precision of 1 μm. The measurement of the position of the focal spot can ensue continuously or at predetermined points in time. It is henceforth also possible to determine the quality of the focal spot (for example its homogeneity), from the curve of the intensity decrease at its edges or a profile of the intensity distribution. With the invention, the potential of damage to the x-ray radiator as a consequence of false positioning of the focal spot can be detected and, if applicable, prevented early.

The housing is appropriately manufactured from a material that is essentially impermeable to x-rays, preferably from lead or tungsten. The device is appropriately fastened to the housing. It is thus a component of the x-ray radiator. Given an exchange of the x-ray radiator, position detecting adjustment of the device to the replaced x-ray radiator as is necessary in the prior art, is not needed. If only the x-ray tube is exchanged, the inventive device remains in the housing. The adjustment of the replaced x-ray tube can ensue in a simple manner with the inventive position detecting device. No further measurement or calibration means need to be provided separately for adjustment to the system, or need to be carried by a service technician for this purpose.

In an embodiment, the device is mounted on a cover that includes a beam exit window. The cover is connected with the housing such that it can be detached. This enables an easy exchange of the device in the case of a defect.

In a further embodiment, the entrance window of the collimator is disposed within the housing. It is thus possible to increase the focal spot at a reduced distance to be monitored and to increase the precision of the adjustment.

It has proven to be advantageous to fashion the collimator in the form of a tube having an axis directed toward a desired position of the fixed-disk storage on the anode. The ratio of the diameter D to the length L of the tube can thereby be smaller than 0.1, preferably smaller than 0.05. The diameter D is advantageously in the range of 30 μm to 2000 μm, preferably 100 μm to 300 μm. A collimator defined by the aforementioned parameters is suited for a particularly exact determination of the position of the focal spot. It can be determined with a precision of approximately 1 μm. Aside from this, with such a collimator it is possible to particularly precisely determine the geometry and the intensity distribution in the area of the focal spot.

The collimator can be produced from a material that is essentially impermeable to x-rays, preferably from lead or tungsten. A detector to measure the x-ray intensity can be provided at the end of the collimator opposite from the entrance window. The detector can be formed by a scintillator and a photodiode downstream in the beam path. It can be accommodated in a measurement housing that is essentially impermeable to x-rays except for an input opening. Such a device for determination of the position of the focal spot can be designed simply it can be produced in a compact, space-saving manner and, in such an embodiment, be disposed within the housing. By disposing the detector in a measurement housing that is essentially impermeable to x-rays, penetration of unwanted interfering radiation is prevented.

According to a further embodiment, the position determining device is a component of a system for deflection of the electron beam that generates the focal spot. For deflection, a regulation device can be provided to adjust and/or to hold the desired position on the anode. In this case the device for determination of the position of the focal spot is a component of the regulation device.

The position of the focal spot can be changed in steps or continuously along a predetermined path by the regulation device. The path can be a wandering or spiral-shaped path. By the change of the position of the focal spot, it is possible to move the focal spot without the device having to be moved. The geometry of the focal spot and/or an intensity distribution in the area thus can be determined.

The present invention is particularly suited for x-ray radiators in which the anode is accommodated in the housing such that it can rotate, for example rotary anode radiators or rotary piston radiators.

DESCRIPTION OF THE PREFERRED EMBODIMENTS

Figure 1:
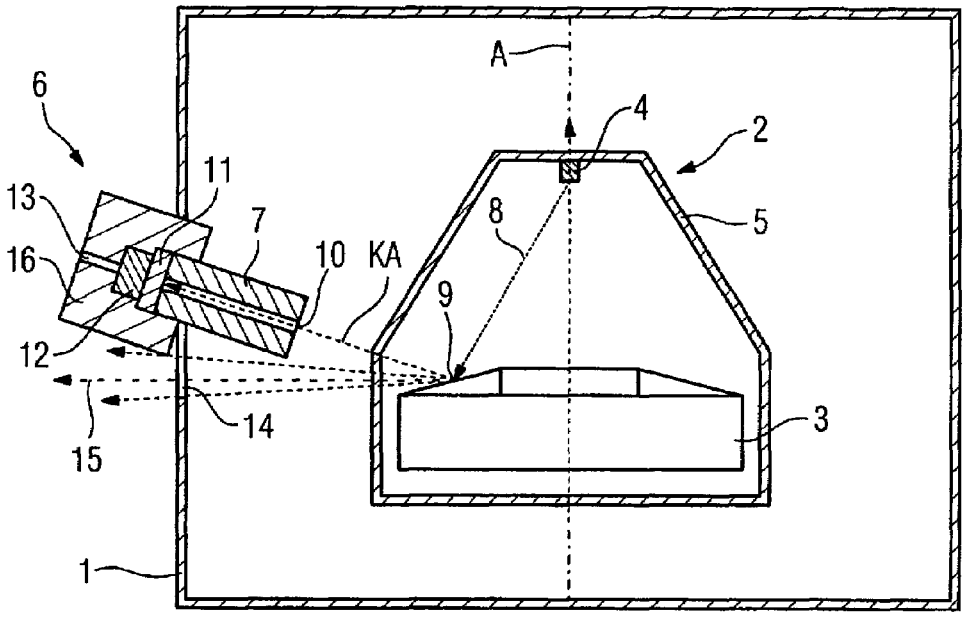
FIG. 1 is a schematic, sectional view of an x-ray radiator in accordance with the invention.

A rotary piston radiator 2 that is mounted such that it can rotate around an axis A is disposed in a housing 1 in FIG. 1. The housing 1 is produced from a material that is essentially impermeable to x-rays, or at least is clad with such a material. Suitable materials are lead or tungsten. The rotary piston radiator 2 has a rotationally-symmetrical anode 3 (here fashioned in the shape of a plate) and a cathode 4 disposed opposite thereto as well as an x-ray tube housing 5 that is fashioned rotationally-symmetric.

A measurement device generally designated with reference numeral 6 is mounted fixed on the housing 1. It includes a collimator tube 7 having a collimator axis KA directed toward a focal spot 9 formed by the electron beam 8 on the anode 3. A scintillator 11 as well as a photodiode 12 downstream in the beam path are mounted at an end of the collimator tube 7 opposite from an entrance window 10. The measurement device 6 has a cable feedthrough 13.

As can be seen from FIG. 1, the measurement device 6 is mounted next to an exit window 14 in the housing 1, such that an x-ray beam 15 emitted from the focal spot 9 is not occluded. The collimator tube 7 as well as a measurement housing 16 surrounding the scintillator 11 and the photodiode 12 are appropriately likewise produced from a material that is essentially impermeable to x-rays, such as lead or tungsten. In contrast, the radiator housing 5 is produced from a material that is permeable to x-rays 15, for example glass or aluminum. In the exemplary embodiment shown in FIG. 1, the measurement device 6 partially protrudes into the housing 1. Naturally it is also possible to dispose the measurement device 6 entirely in the housing 1. Alternatively, only the collimator tube 7 can protrude into the housing 1. In the exemplary embodiment shown here, the entrance window 10 of the collimator tube 7 is located within the housing 1.

FIG. 2 again shows the measurement device 6. The geometric execution of the collimator tube 7 as well as its distance AB from the focal spot 9 determine the precision with which the shape and the position of the focal spot 9 can be determined. In this context, it has proven to be advisable that a ratio of a first diameter D to the length L of the collimator tube 7 is preferably in the range of 0.08 to 0.12, particularly in the range of 0.1. The following relation applies for the second diameter T of a detectable region on the anode 3 as well as an opening angle 2 α:

$$D/L=\tan\alpha=(T/2)/(AB+L/2)$$

From this it is clear that the detectable second diameter T on the anode 3 is smaller with decreasing size of the ratio D/L, and thus the measurement precision of the device 6 is greater. It has proven to be particularly advantageous to select the diameter D in the range of 100 μ to 300 μ.

Figure 2:
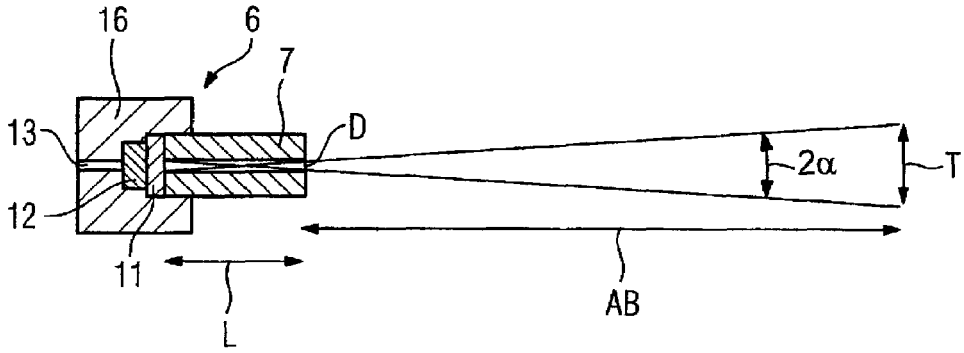
FIG. 2 is a schematic, sectional view of a measurement device according to FIG. 1.
Figure 3:
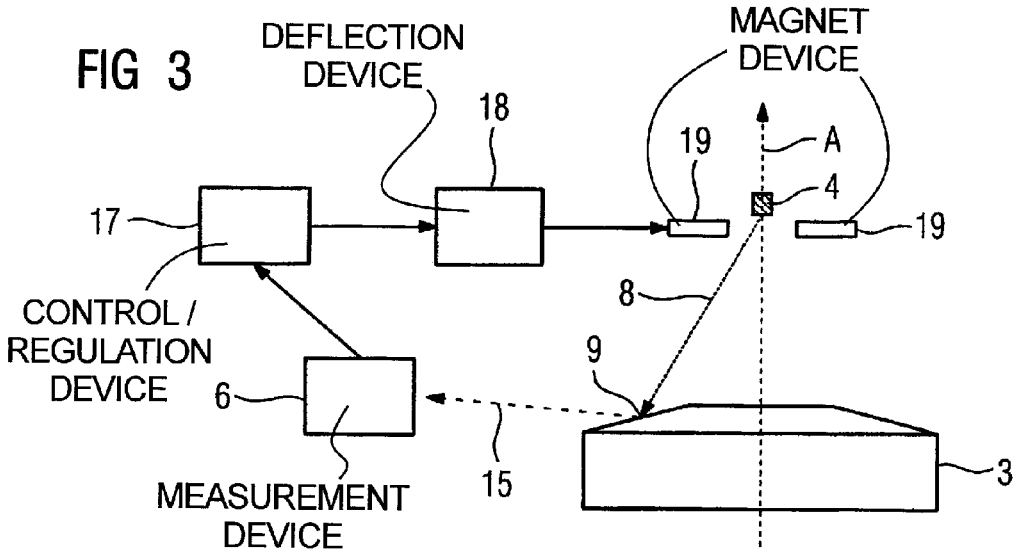
FIG. 3 is a schematic representation of a control regulation device for adjustment of the position of a focal spot.

FIG. 3 shows a schematic representation of a control/regulation device using the measurement device 6 explained in FIGS. 1 and 2. The measurement device 6 is connected with a control/regulation device 17. The measurement values supplied by the measurement device 6 are evaluated by means of the control/regulation device 17 and converted into control/regulation signals according to a predetermined algorithm. The control/regulation signals are in turn transmitted to a downstream deflection device 18. The deflection device 18 activates magnet devices 19 with which the electron beam 8 is deflected, and with which the position of the focal spot 9 on the anode 3 can be adjusted.

Figure 4:
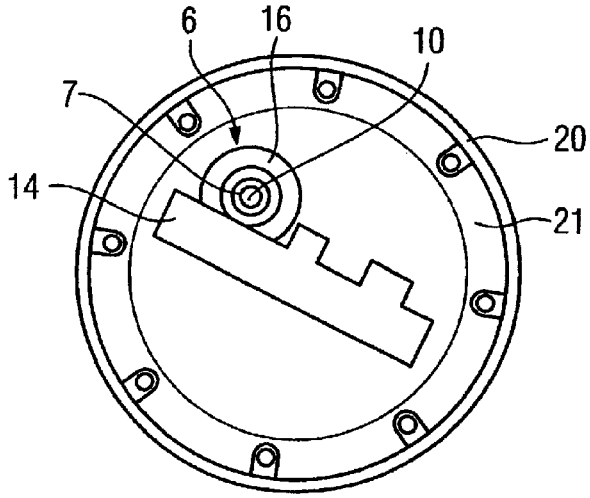
FIG. 4 is a plan view of the inside of a housing cover with the measurement device.

FIG. 4 shows a plan view of the side of a cover 20 facing the inside of a housing. The measurement device 6 with the measurement housing 16 as well as the collimator tube 7 extending therefrom are mounted in the immediate vicinity of the exit window 14. On its inner side facing the x-ray radiator 2, the cover 20 is provided with a coating 21 that is produced from a material (for example lead) that is essentially impermeable to x-rays.

Figure 5A:
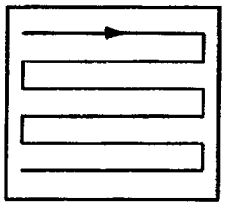
FIGS. 5*a* and 5*b* the course of two paths for movement of the focal spot.
Figure 5B:
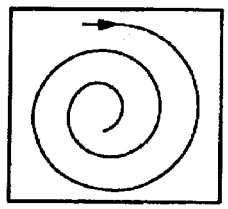

FIGS. 5*a* and 5*b* show two alternatives in which the focal spot 9 on the anode 3 can be moved by means of the deflection devices 18 and magnet devices 19. Such a movement of the focal spot 9 enables its geometry and intensity distribution radiated from the focal spot 9 to be determined by the measurement device 6. In this manner, the focal spot 9 can be held particularly exactly in a predetermined desired position. It is naturally also possible to move the focal spot 9 by means of the deflection devices 18 and magnet devices 19 in different ways from those shown in FIGS. 5*a* and 5*b*.

Figure 6:
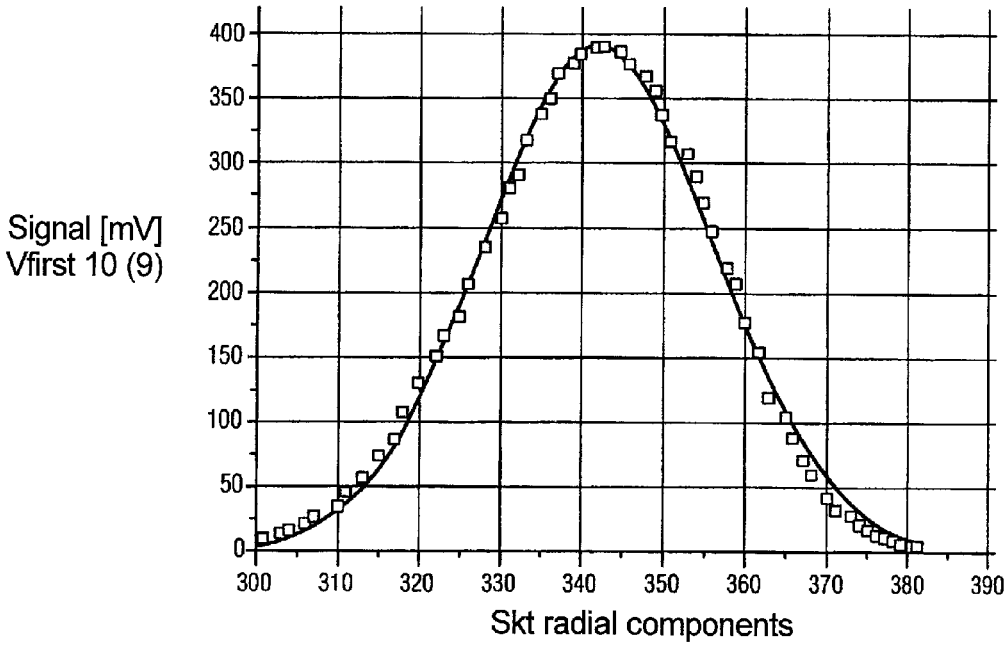
FIG. 6 shows the intensity distribution of x-rays emitted by the focal spot along a radial path proceeding through the focal spot.
Figure 7:
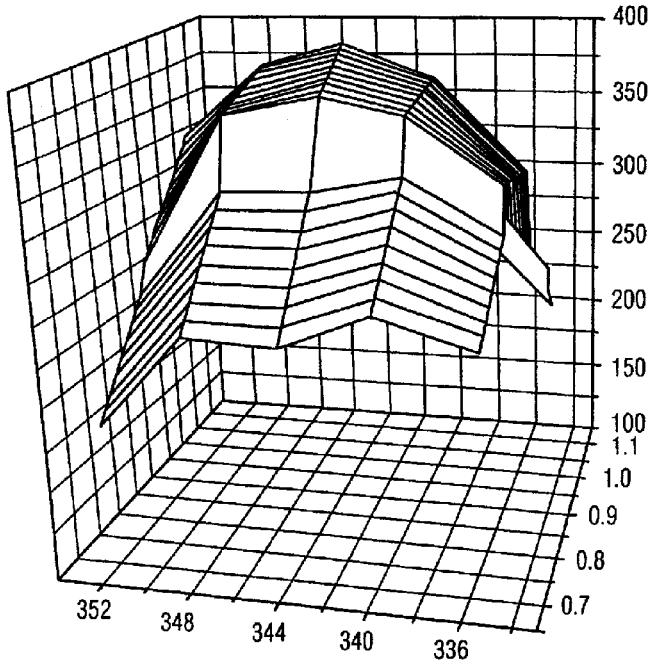
FIG. 7 is a three-dimensional representation of the intensity distribution of the x-ray radiation emitted from the focal spot.

FIG. 6 shows the intensity distribution measured with the inventive device 6 along a path proceeding radially through the focal path. If the area of the focal spot 9 is moved, for example along the paths shown in FIG. 5*a* or 5*b*, a three-dimensional determination of the intensity distribution of the x-ray radiation 15 radiated from the focal spot 9 can be made. An example of the result of such a measurement is shown in FIG. 7.

Using the results shown in the example in FIG. 6, it is possible to achieve an intelligent, self-regulating control/regulation device 17 with which the focal spot 9 is always automatically held in a desired position. For this purpose, the intensity values measured by the measurement device 6 are transmitted to the control/regulation device 17. The electron beam 8 is always deflected by means of a suitable algorithm by the deflection devices 18 and the magnet devices 19, such that the intensity measured with the measurement device 6 is maximal. The focal spot 9 thus can be held in the desired position in a simple manner. However, a requirement for this is a precise adjustment of the measurement device 6. It is also possible to set the measurement device 6 roughly on the desired position, i.e. on a position that does not exactly correspond to the desired position. For adjustment, the focal spot 9 is initially moved until it is located in this position. The focal spot 9 can be subsequently moved from this position into the desired position according to previously, exactly determined and stored parameters.

However, with the proposed x-ray device it is also possible to detect potential damage to the anode 3 early and to transmit to the user an instruction for a necessary exchange of the x-ray radiator. Damage thus can be detected and corrected in an early stage. Consequent damages as well as an unforeseen failure of the x-ray device can be prevented as a consequence.

The geometry of the focal spot 9 also can be influenced and adjusted by a suitable activation of the magnet device 19. Conclusions about the edge steepness of an intensity decrease at the edges of the focal spot 9 are also possible.

Regulation of the position of the focal spot 9 solely on the basis of a relative signal evaluation is possible with the disclosed measurement device 6. It is not necessary to measure an absolute signal strength. As a result, elaborate and expensive calibration of the measurement device 6 can be foregone. For moving the focal spot 9, the deflection device 18 can be operated such that the position of the focal spot 9 is changed continuously or in steps according to the paths shown in FIGS. 5*a* and 5*b*. As soon as such a movement event is concluded, the focal spot 9 is optimally adjusted in terms of its position to a desired position according to a predetermined algorithm.

Although modifications and changes may be suggested by those skilled in the art, it is the intention of the inventors to embody within the patent warranted hereon all changes and modifications as reasonably and properly come within the scope of their contribution to the art.

The invention claimed is:

1. An x-ray radiator comprising:

a housing;

an anode disposed in said housing;

a cathode that generates an electron beam directed at said anode to produce x-rays emanating from a focal spot on said anode;

a measurement device comprising a position detector that determines a position of said focal spot on said anode, comprising a collimator aligned to said focal spot, said collimator comprising a tube having an axis directed toward a desired position of said focal spot on said anode;

a deflection arrangement that deflects said electron beam relative to said anode; and a regulating device connected to an output of said position detector that controls said deflection arrangement to adjust or hold said focal spot, dependent on said output, relative to a desired position of the focal spot on the anode.

2. An x-ray radiator as claimed in claim 1 wherein said housing is comprised of a material substantially impermeable to x-rays.

3. An x-ray radiator as claimed in claim 2 wherein said material is selected from the group consisting of lead and tungsten.

4. An x-ray radiator as claimed in claim 1 wherein said position detector is attached to said housing.

5. An x-ray radiator as claimed in claim 1 wherein said housing has a wall comprising an x-ray exit window, and wherein said position detector is mounted on said wall.

6. An x-ray radiator as claimed in claim 1 wherein said collimator has an entrance window disposed inside said housing.

7. An x-ray radiator as claimed in claim 1 wherein said tube has a diameter and a length, with a ratio of said diameter to said length being less than 0.1.

8. An x-ray radiator as claimed in claim 7 wherein said ratio is less than 0.05.

9. An x-ray radiator as claimed in claim 7 wherein said diameter is in a range between 30 μm and 2000 μm.

10. An x-ray radiator as claimed in claim 9 wherein said diameter is in a range between 100 μm and 300 μm.

11. An x-ray radiator as claimed in claim 1 wherein said collimator is comprised of a material that is substantially impermeable to x-rays.

12. An x-ray radiator as claimed in claim 11 wherein said material is selected from the group consisting of lead and tungsten.

13. An x-ray radiator as claimed in claim 1 wherein said collimator has an entrance window facing said anode, and wherein said measurement device comprises a detector, connected at an end of said tube opposite said entrance window, for measuring an x-ray intensity of x-rays proceeding through said collimator to said measurement device.

14. An x-ray radiator as claimed in claim 13 wherein said x-rays propagate through said tube in a propagation direction, and wherein said detector comprises a scintillator followed by a photodiode in said propagation direction.

15. An x-ray radiator as claimed in claim 13 wherein said detector comprises a measurement unit housing composed of material substantially impermeable to x-rays.

16. An x-ray radiator as claimed in claim 1 wherein said regulation device moves said focal spot along a predetermined path on said anode in a movement mode selected from the group consisting of movement steps and continuous movement.

17. An x-ray radiator as claimed in claim 1 wherein said anode is rotatably mounted in said housing.

* * * * *